US008491323B2

(12) United States Patent
Ishibashi

(10) Patent No.: US 8,491,323 B2
(45) Date of Patent: Jul. 23, 2013

(54) WATERPROOF CONNECTOR

(75) Inventor: Takeshi Ishibashi, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 38 days.

(21) Appl. No.: 13/245,063

(22) Filed: Sep. 26, 2011

(65) Prior Publication Data

US 2012/0149226 A1 Jun. 14, 2012

(30) Foreign Application Priority Data

Dec. 13, 2010 (JP) ..... 2010-277094

(51) Int. Cl.
*H01R 4/60* (2006.01)

(52) U.S. Cl.
USPC ..... 439/205; 439/271

(58) Field of Classification Search
USPC ..... 439/205, 206, 207, 271
See application file for complete search history.

(56) References Cited

U.S. PATENT DOCUMENTS 3,657,681 A * 4/1972 Falkner ..... 439/205
3,678,432 A * 7/1972 Boliver ..... 337/201
3,772,636 A * 11/1973 Webb ..... 439/201
3,953,099 A * 4/1976 Wilson ..... 439/205
4,553,807 A * 11/1985 Cane ..... 439/272
4,802,867 A * 2/1989 Palmer ..... 439/587
5,358,420 A * 10/1994 Cairns et al. ..... 439/206
5,564,951 A * 10/1996 Attal et al. ..... 439/676
5,879,179 A 3/1999 Fukuda
6,113,407 A * 9/2000 Martin ..... 439/205
6,210,191 B1 * 4/2001 Sai ..... 439/274
6,249,218 B1 * 6/2001 Blair ..... 340/435
6,511,337 B1 * 1/2003 Fandrey et al. ..... 439/320

* cited by examiner

*Primary Examiner* — Phuong Dinh
(74) *Attorney, Agent, or Firm* — Gerald E. Hespos; Michael J. Porco; Matthew T. Hespos

(57) ABSTRACT

A waterproof connector has an equipment-side housing (52) with a hood (55) and an wire-side housing (22) with tubular fit-on parts (24) and an interlocking fit-on part (25) that can fit in the hood (55). A rubber ring (33) is fit around an outer peripheral surface of the cylindrical fit-on parts (24) and the interlocking fit-on part (25) to seal a gap between an inner peripheral surface of the hood (55) and an outer peripheral surface of the tubular fit-on parts (24) and the interlocking fit-on part (25). A sealing surface (55A) is formed on the inner peripheral surface of the hood part (55) and closely contacts an entire outer periphery of the rubber ring (33). Air release grooves (66) are formed on portions of the inner peripheral surface of the hood (55) forward of the sealing surface (55A).

9 Claims, 12 Drawing Sheets

WATERPROOF CONNECTOR

BACKGROUND OF THE INVENTION

1. Field of the Invention

The invention relates to a waterproof connector.

2. Description of the Related Art

U.S. Pat. No. 5,879,179 discloses a waterproof connector to be used to connect wire harnesses to each other. This waterproof connector has a first housing with a hood and a second housing having a fit-on part to be fit in the hood of the first housing.

A rubber ring is fit on a fit-on part of the second housing. The entire circumference of the rubber ring closely contacts an inner peripheral surface of the hood and the peripheral surface of the fit-on part when the first and second housings are fit together, thus preventing water and the like from penetrating into the gap between the hood and the fit-on part. A rubber stopper normally is fit on an electric wire pulled out of each housing. The rubber stopper closely contacts the peripheral surface of the electric wire and the inner peripheral surface of each housing, thus preventing water and the like from penetrating into the gap between the electric wire and each housing. As a result, the inside of the waterproof connector is sealed to prevent water and the like from penetrating therein.

The rubber ring on the fit-on part of the above-described waterproof connector closely contacts the inner peripheral surface of the open portion of the hood when the fit-on part is fit in the hood, thus sealing the waterproof connector. Air inside the waterproof connector is compressed while inserting the fit-on part into the hood. Thus there is an increase in an operational force when fitting the first and second housings together. In addition, the rubber ring is inserted into the hood from an open end to an inner portion with the rubber ring closely contacting the inner peripheral surface of the hood. Thus there is a further increase in the operational force in fitting the first and second housings together. The front of the hood could be widened and the inside of the hood could become narrower toward the inner portion thereof so that the rubber ring does not contact the hood until midway. This design would decrease a rise of the internal pressure of the waterproof connector. However, the second housing would incline with respect to its normal posture and would loosen. Consequently the first and second housings could not be fit smoothly together.

The invention has been completed in view of the above-described situation. Thus it is an object of the invention to decrease an operational force required to fit an electric wire-side connector housing and an equipment-side connector housing on each other and smoothly fit both housings together.

SUMMARY OF THE INVENTION

The invention provides a waterproof connector including a first housing having a hood and a second housing having a fit-on part that can be fit in the hood. A rubber ring which is inserted into the hood part from an open portion thereof to an inner portion thereof is fit on the fit-on part with the rubber ring in close contact with an inner peripheral surface of the hood and a peripheral surface of the fit-on part. A sealing surface is formed on the inner peripheral surface of the hood and closely contacts an entire circumference of the rubber ring when the first and second housings are fit normally together. An air release part is formed on portions of the inner peripheral surface of the hood at a side of the open portion thereof for releasing air inside the hood to the outside. Thus, internal pressure of the waterproof connector is lower than in the prior art and the operational force required to fit the first and second housings together also is lower.

The air release part may be a groove that extends from the sealing surface of the hood to the open end thereof and opens toward an inner space of the hood. In this construction, the portion where the air release part is formed does not closely contact the rubber ring. Thus, operational force required to fit the first and second housings together is significantly lower.

A plurality of the air release grooves may be formed on the inner peripheral surface of the hood. The plurality of the air release grooves enable air inside the hood to be discharged outside more efficiently. Thus, the operational force required to fit the first and second housings together can be decreased significantly.

A rib-shaped rubber ring interference portion may be formed between the air release parts formed on the inner peripheral surface of the hood. The interference portion extends from the sealing surface of the hood to the open portion of the hood and can closely contacting the rubber ring.

This construction allows the first and second housings to reach the normal fit-on posture with a low contact resistance between the rubber ring and the hood. Thus, the operational force required to fit the first and second housings together is decreased greatly.

DETAILED DESCRIPTION OF THE PREFERRED EMBODIMENT

A shielding connector assembly in accordance with the invention has an electric wire-side connector 20 connected to an end of a shielding electric wire and an equipment-side connector 50. The equipment-side connector 50 is fixed to a case C of equipment and can fit on the electric wire-side connector 20.

Figure 1:
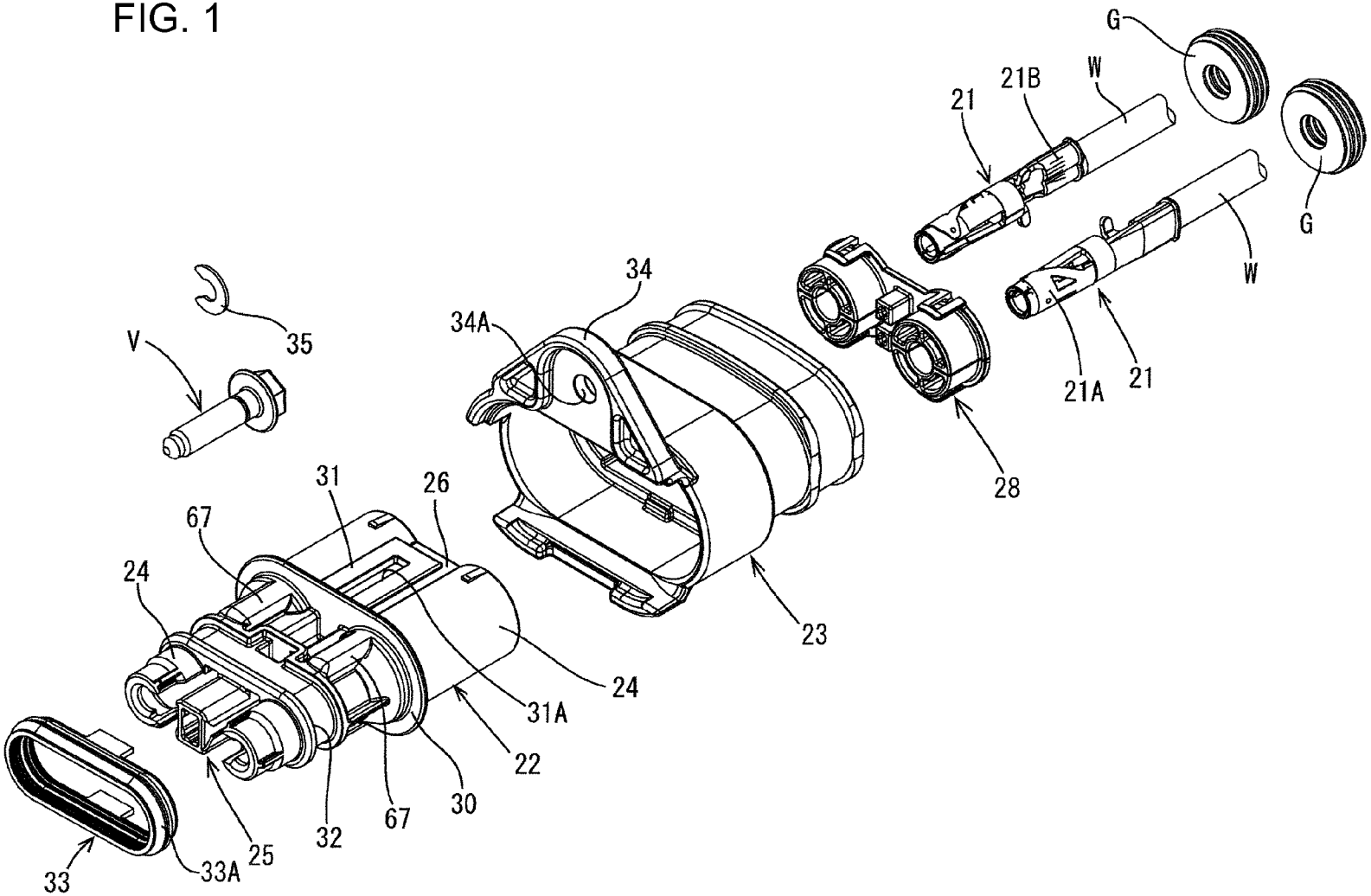
FIG. 1 is an exploded perspective view of an electric wire-side connector according to an embodiment of the present invention.
Figure 6:
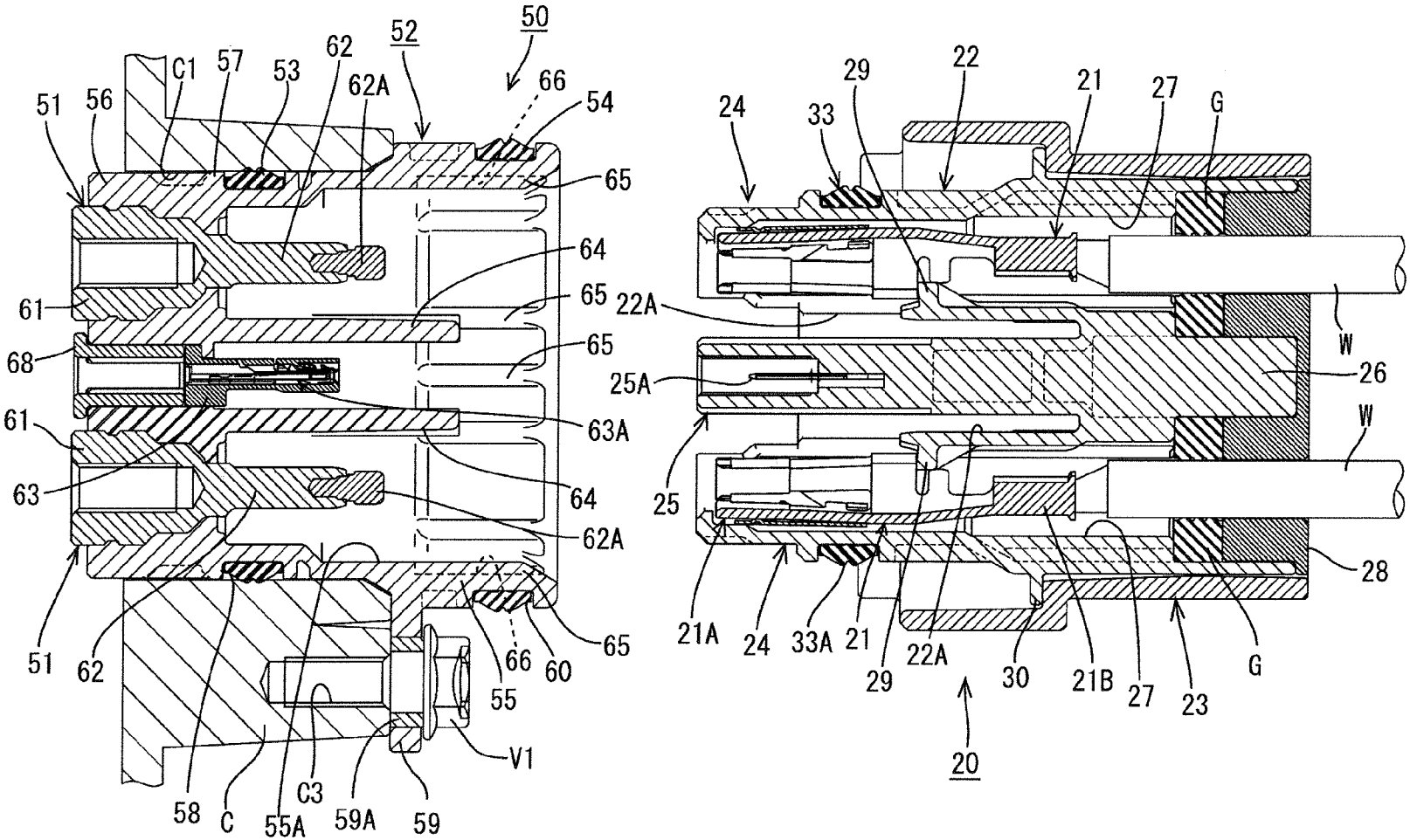
FIG. 6 is a sectional view showing a state before the electric wire-side connector and the equipment-side connector are fit together, when both connectors seen from above.

As shown in FIGS. 1 and 6, the wire-side connector 20 has female terminal fittings 21 connected to ends of two shielding electric wires W, a wire-side housing 22 made of a synthetic resin and a shielding shell 23 covering the wire-side housing 22. The female terminal fittings 21 are accommodated in the wire-side housing 22

The female terminal fitting 21 has a cylindrical connection part 21A extended in its forward and backward direction and a barrel 21B disposed rearward from the cylindrical connection part 21A. The barrel 21B is crimped to the shielding electric wire W to electrically connect the female terminal fitting 21 and the shielding electric wire W to each other. A rubber stopper G is mounted on the shielding electric wire W.

The wire-side housing 22 has two approximately cylindrical fit-on parts 24 that extend in a forward and backward direction and a quadrangular prism-shaped interlocking fit-on part 25 that also extends in the forward and backward direction.

The cylindrical fit-on parts 24 and the interlocking fit-on part 25 are formed unitarily and side by side so that front areas of the cylindrical fit-on parts 24 sandwich the interlocking fit-on part 25 therebetween. A coupling 26 extends unitarily between areas of the cylindrical fit-on parts 24 rearward of an approximately center in the forward and backward direction. Slit 22A are formed between the interlocking fit-on part 25 and each of the cylindrical fit-on parts 24. The interlocking fit-on part 25 is open forward and a short-circuit terminal 25A is mounted inside the interlocking fit-on part 25.

A cavity 27 extends in the forward and backward direction in each cylindrical fit-on part 24 and the female terminal fittings 21 can be accommodated inside the cavities 27. The rubber stoppers G mounted on the shielding electric wires W closely contact inner peripheral surfaces of the cavities 27 when the female terminal fittings 21 are inserted into the cavities 27 from the rear to prevent water from penetrating into the cavity 27 from the rear. A stopper hold-down member 28 is fit on the shielding electric wires W rearward of the rubber stoppers G and is mounted on the cylindrical fit-on parts 24 to prevent the rubber stopper G from being removed from the rear end of the cylindrical fit-on parts 24.

As shown in FIG. 6, a lance 29 is formed on an inner wall of each cavity 27 disposed at the end with the interlocking fit-on part 25. Each lance 29 locks a rear end of the cylindrical connection part 21A of the female terminal fitting 21 accommodated in the cavity 27, thus holding the female terminal fitting 21 in the cavity 27 and preventing the female terminal fitting 21 from being removed from the rear end thereof.

Figure 9:
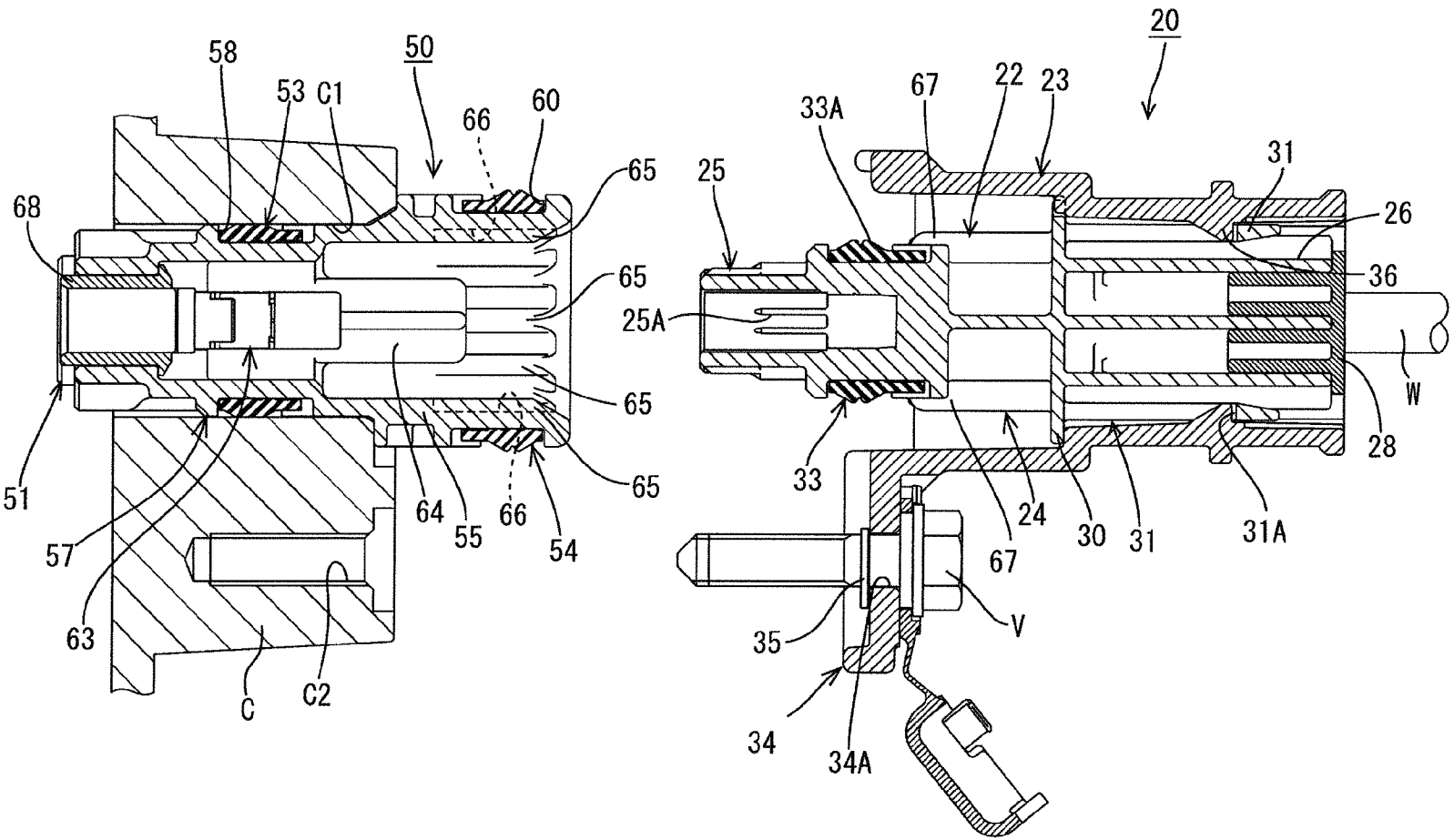
FIG. 9 is a sectional view showing a state before the electric wire-side connector and the equipment-side connector are fit together when both connectors are seen laterally.

As shown in FIGS. 1 and 9, a flange 30 projects from an approximately center of the wire-side housing 22 in its forward and backward direction and extends around the entire periphery. Two elastically deformable locking strips 31 extend rearward from a rear surface of the flange 30 at positions opposed to the coupling 26. A locking hole 31A is formed at the central portion of each of the locking strips 31.

As shown in FIGS. 6 and 9, a rubber ring accommodation groove 32 is formed on the cylindrical fit-on parts 24 and the interlocking fit-on part 25 at a position forward from the flange 30 of the wire-side connector housing 22. A rubber ring 33 having is fit on the rubber ring accommodation groove 32 and has a plurality of peripheral lips 33A.

Figure 3:
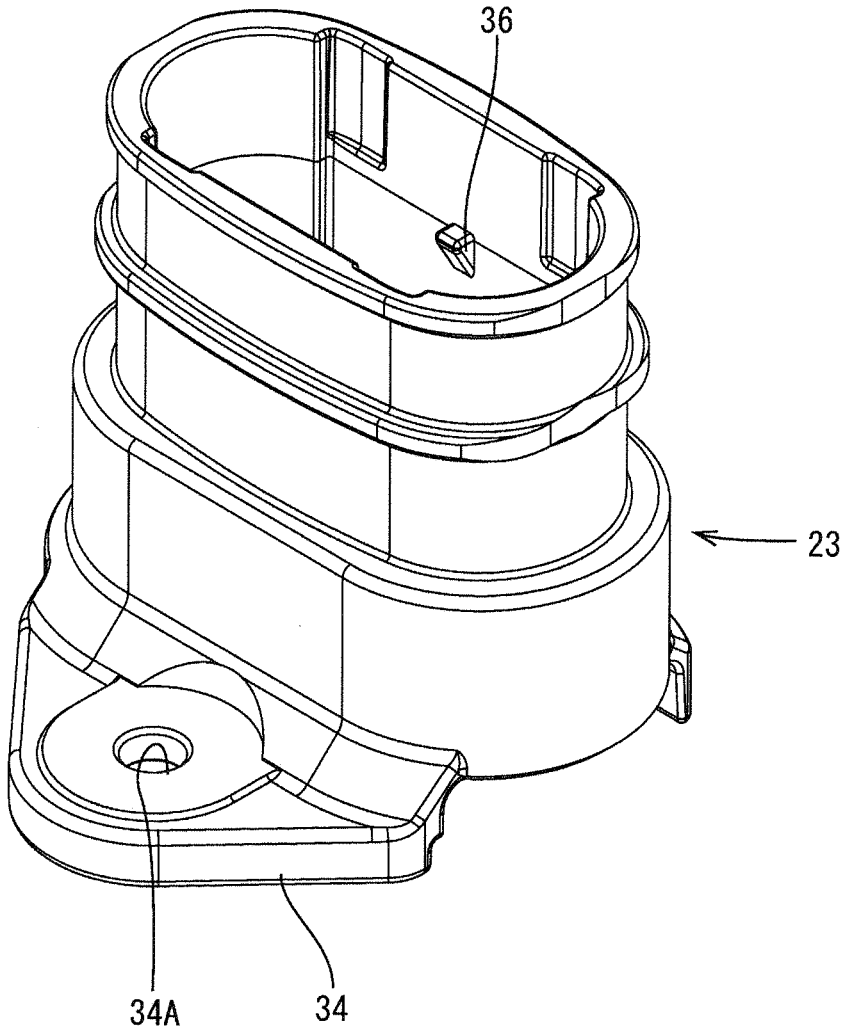
FIG. 3 is a perspective view of a shielding shell according to the embodiment.
Figure 4:
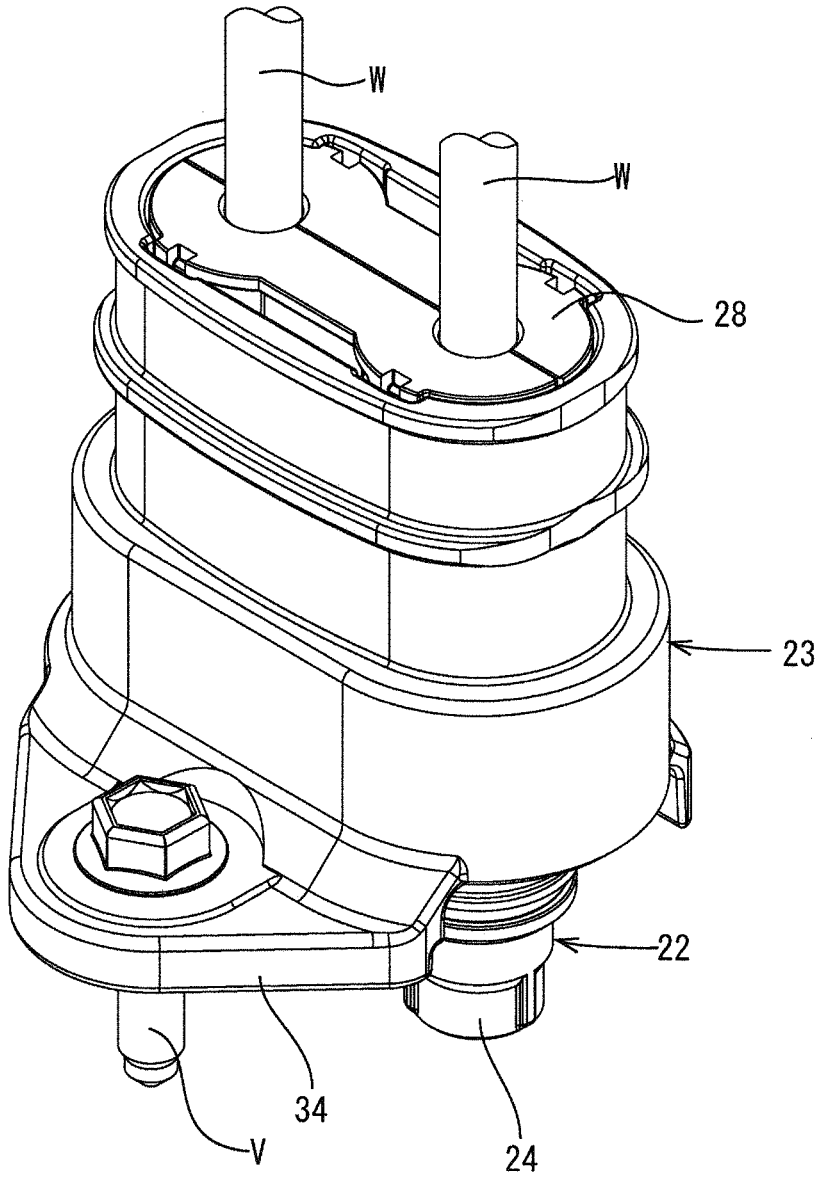
FIG. 4 is a perspective view of the electric wire-side connector of FIG. 1.

The shielding shell 23 is made of die-cast aluminum. As shown in FIGS. 1 and 3, the shielding shell 23 extends in the forward and backward direction and defines a wide oblong in the width direction. Front and rear ends of the shielding shell 23 are open and the wire-side housing 22 can be inserted into the open front end of the shielding shell 23.

A locking projection 36 is formed at a widthwise center of inner peripheral surfaces of each long side of the shielding shell 23, as shown in FIGS. 3 and 9. The locking projection 36 locks in the locking hole 31A of the locking strip 31 when the wire-side housing 22 is accommodated inside the shielding shell 23 at a predetermined normal position, as shown in FIG. 6, to hold the wire-side housing 22 in the shielding shell 23.

Parts of the cylindrical fit-on parts 24 and the interlocking fit-on part 25 forward of the properly mounted rubber ring 33 project forward from the open front end of the shielding shell 23 when the wire-side housing 22 is fit normally fitted in the shielding shell 23, as shown in FIGS. 6 and 9.

Figure 7:
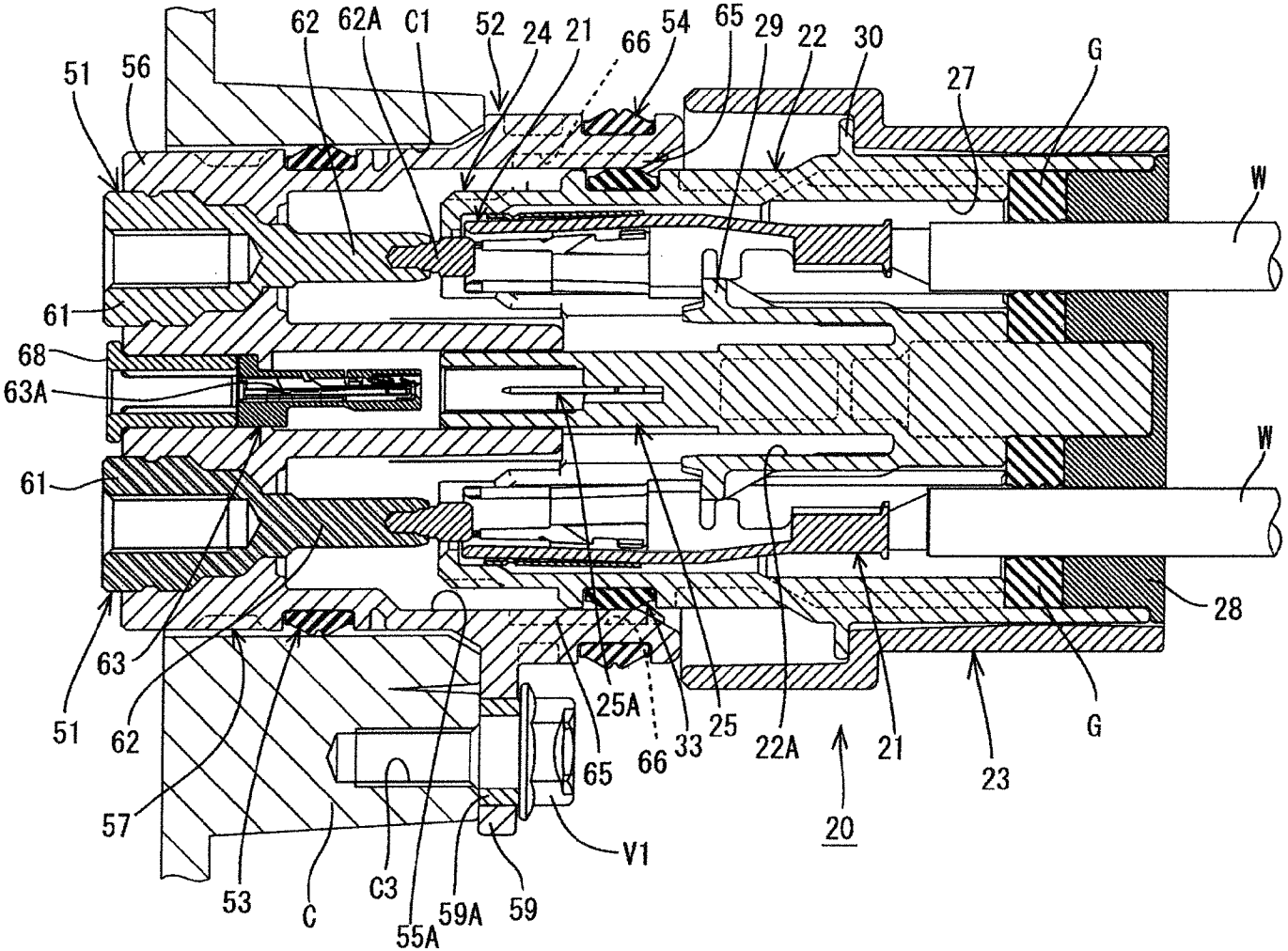
FIG. 7 is a sectional view showing the electric wire-side connector and the equipment-side connector of FIG. 6 fit partly together.
Figure 10:
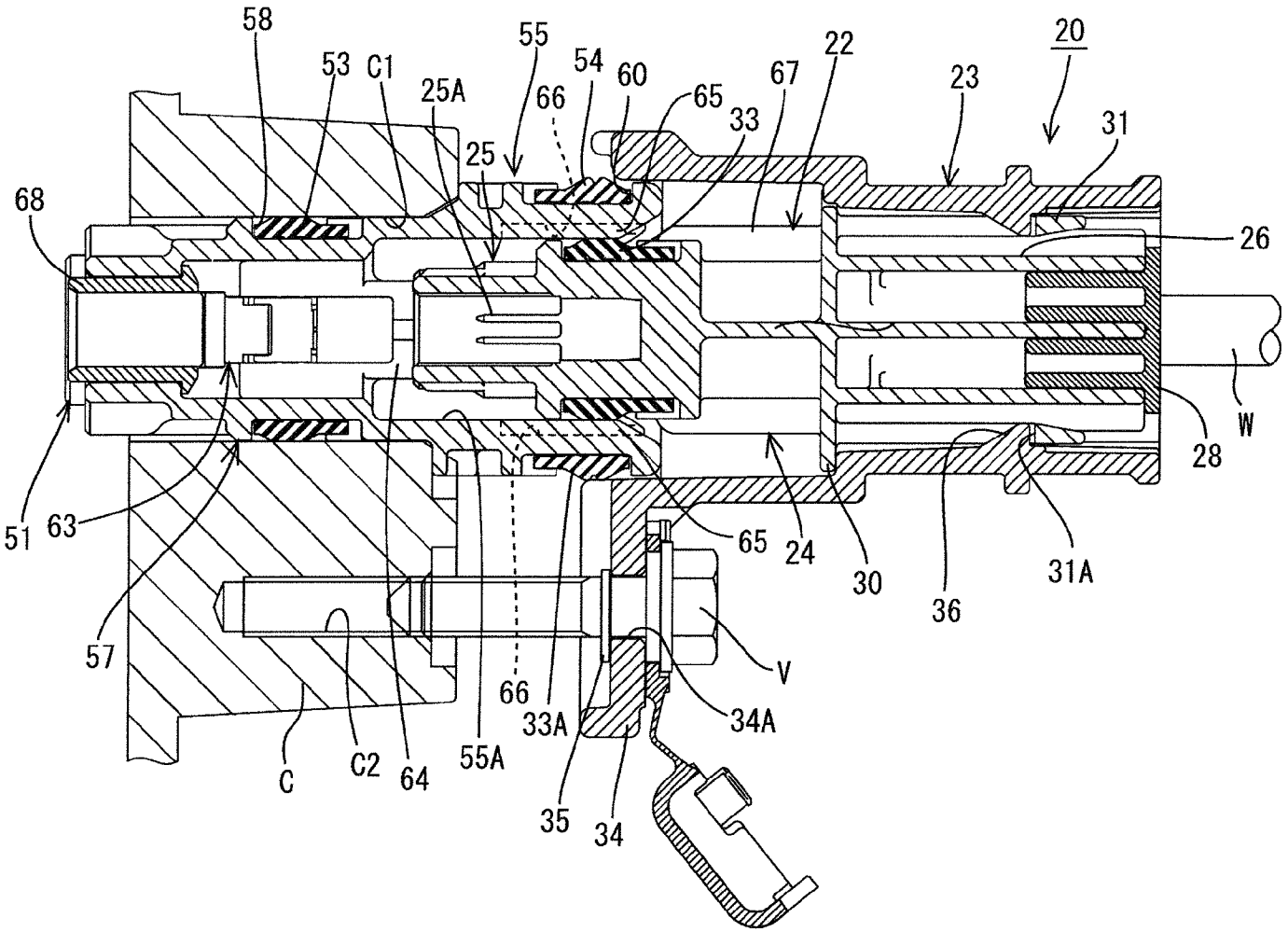
FIG. 10 is a sectional view showing the electric wire-side connector and the equipment-side connector of FIG. 9 fit partly together.

A fixing part 34 extends radially out from a front opening edge of one of the long sides of the shielding shell 23 and a bolt insertion hole 34A penetrates through the fixing part 34 in the forward and backward direction. A tightening bolt V is inserted through the bolt insertion hole 34A and held by at fixing part 34 by a C ring 35, as shown in FIG. 9. The wire-side connector 20 and the equipment-side connector 50 fixed to the case C of equipment are fit shallowly together, as shown in FIG. 10. The tightening bolt V then is tightened into a bolt-tightening hole C2 of the case C to fit the wire-side connector 20 and the equipment-side connector 50 together normally, as shown in FIG. 7.

Figure 8:
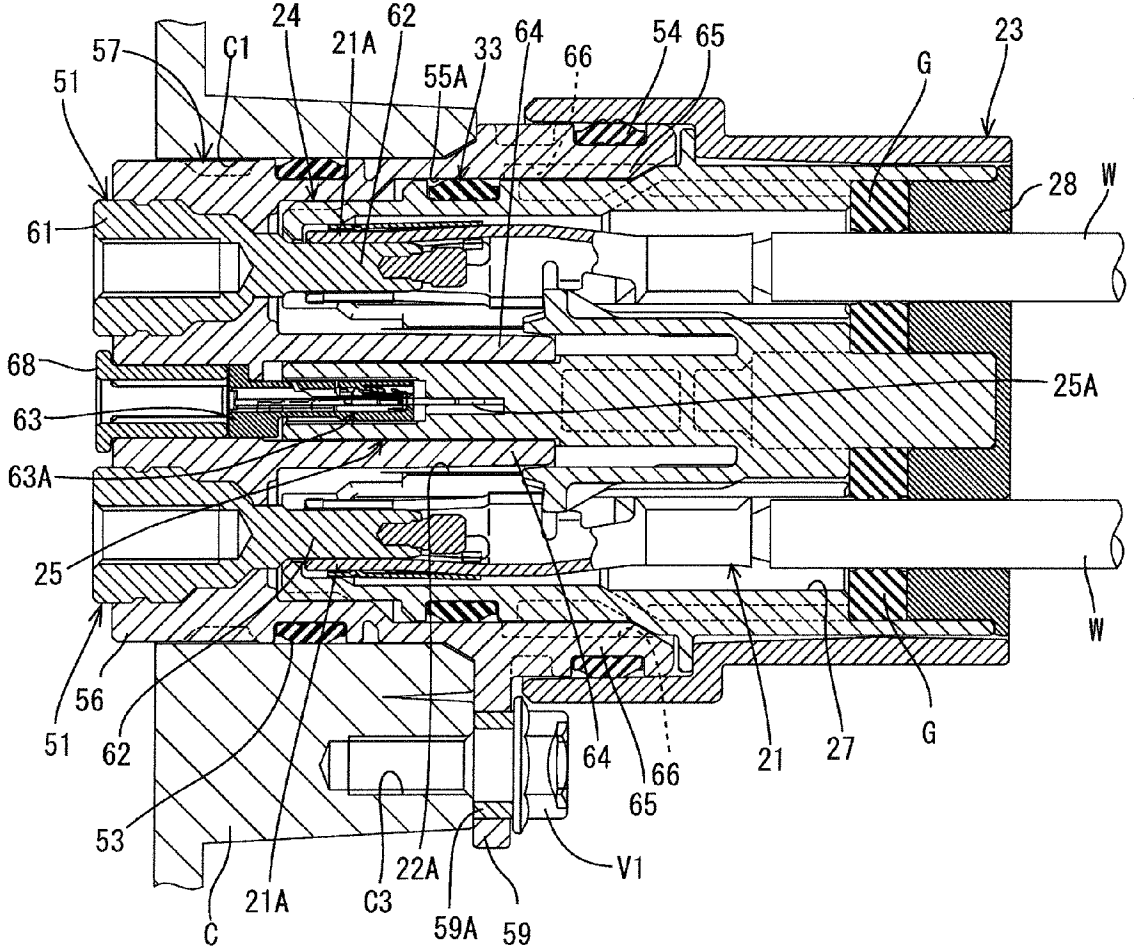
FIG. 8 is a sectional view showing the electric wire-side connector and the equipment-side connector of FIG. 6 fit completely together.
Figure 11:
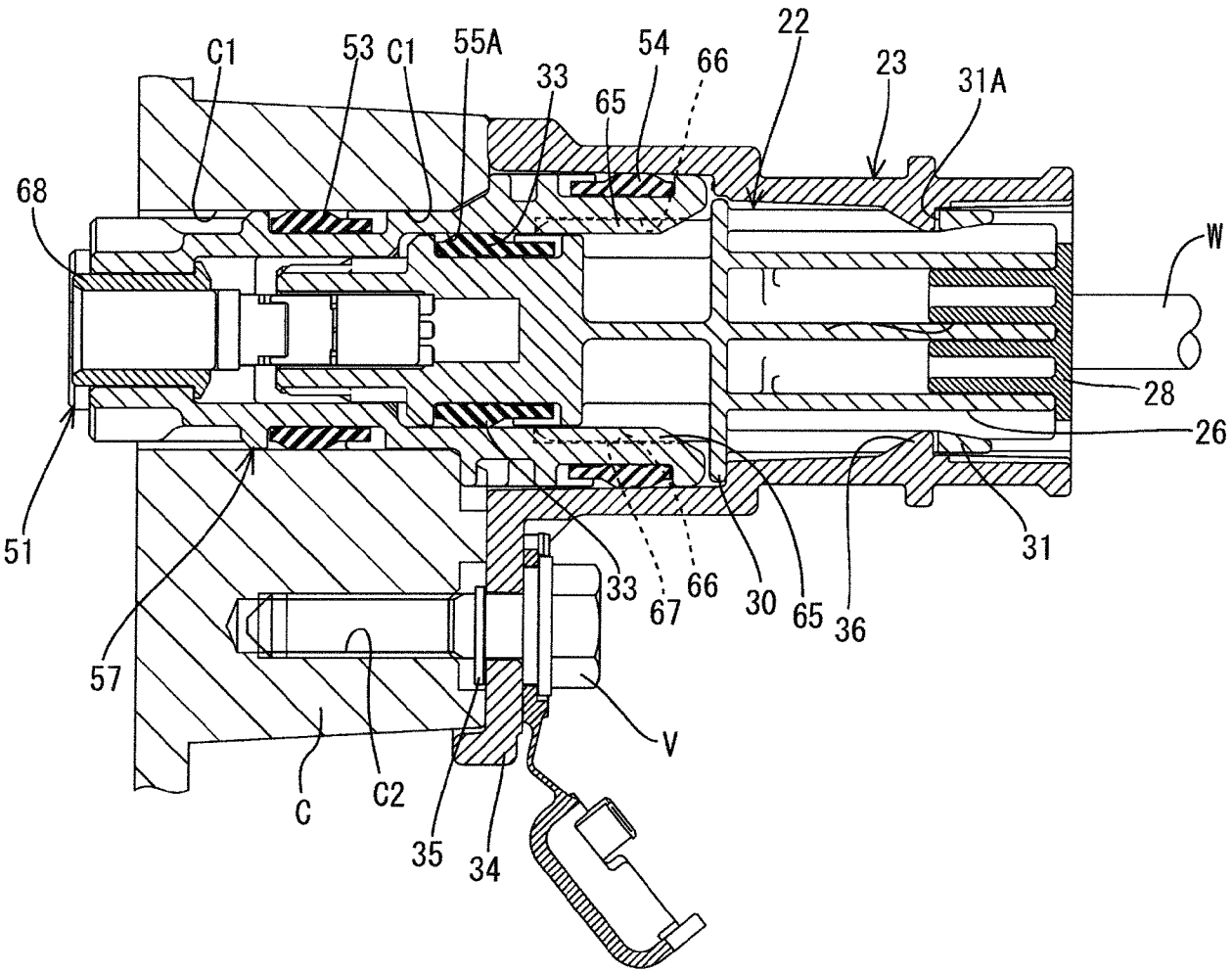
FIG. 11 is a sectional view showing the electric wire-side connector and the equipment-side connector of FIG. 9 fit completely together.

The front opening edge of the shielding shell 23, including a front surface of the fixing part 34, closely contact the case C when the wire-side connector 20 and the equipment-side connector 50 are fit normally together, as shown in FIGS. 8 and 11. Thus the case C and the shielding shell 23 are connected conductively to each other.

Figure 2:
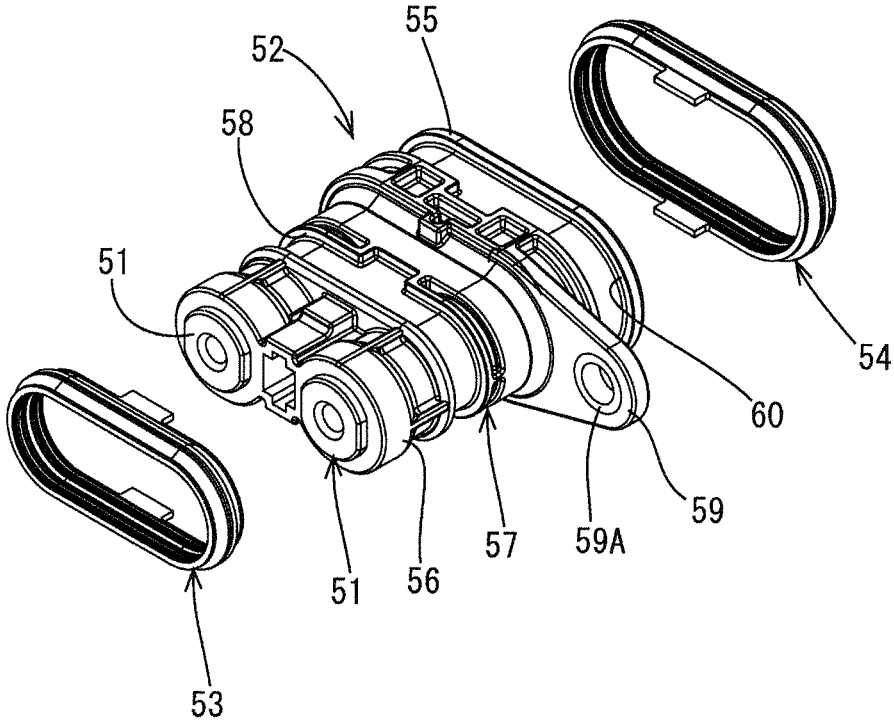
FIG. 2 is an exploded perspective view of an equipment-side connector housing according to the embodiment.

The equipment-side connector 50 has an equipment-side housing 52 formed by molding a synthetic resin and male terminal fittings 51 are accommodated therein, as shown in FIGS. 2 and 6. First and second rubber rings 53, 54 are fit on a peripheral surface of the equipment-side housing 52.

Figure 5:
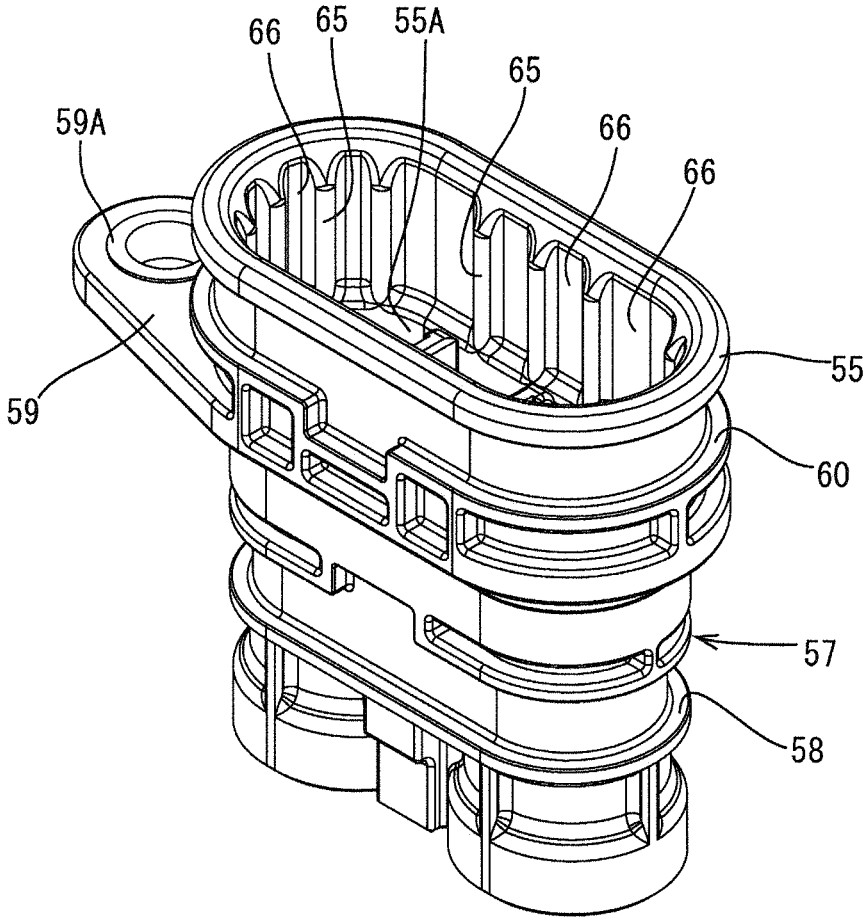
FIG. 5 is a perspective view of an equipment-side connector housing.

As shown in FIGS. 2 and 5, the equipment-side housing 52 has a hood 55 that can accommodate the cylindrical fit-on parts 24 and the interlocking fit-on part 25 of the wire-side housing 22 therein. A terminal fitting holding part 56 is rearward of the hood 55.

An equipment-side fit-on part 57 is defined at a rear portion of the hood 55 of the equipment-side housing 52 and can be fit in a mounting hole C1 in the case C of the equipment. A first rubber ring accommodation groove 58 is formed around the peripheral surface of the equipment-side fit-on part 57 and accommodates a first rubber ring 53. The entire periphery of the first rubber ring 53 closely contacts the inner peripheral wall of the mounting hole C1 of the case C when the equipment-side fit-on part 57 is fit in the mounting hole C1 to prevent water and the like from penetrating into the case C from the outside.

As shown in FIGS. 8 and 11, portions of the cylindrical fit-on parts 24 and the interlocking fit-on part 25 forward of the flange 30 are accommodated inside the hood 55 when the wire-side housing 22 and the equipment-side housing 52 are fit together normally. Additionally, the inner peripheral surface of the open portion of the hood 55 closely contacts the peripheral surfaces of the cylindrical fit-on parts 24 and the interlocking fit-on part 25.

The hood 55 is a tube that extends in the forward and backward direction and has an oblong cross section that is long in the width direction, as shown in FIGS. 5 and 6. A front section of the hood 55 can fit inside the shielding shell 23 of the wire-side connector 20. The entire periphery of the rubber ring 33 of the wire-side housing 22 closely contacts the inner peripheral sealing surface 55A of the hood 55 when the wire-side connector 20 and the equipment-side connector 50 are fit normally together.

A second rubber ring accommodation groove 60 is formed around the entire periphery of the front end of the hood 55 and receives a second rubber ring 54. The entire periphery of the second rubber ring 54 closely contacts the inner peripheral surface of the shielding shell 23 when the wire-side connector 20 and the equipment-side connector 50 are fit together to prevent water and the like from penetrating into the gap between the hood 55 and the shielding shell 23 from the outside.

A fixing strip 59 projects laterally out at a widthwise side of the hood 55 at approximately the center of the hood 55 in the forward and backward direction and a metal collar 59A is mounted on the fixing strip 59. The equipment-side fit-on part 57 is fit in the mounting hole C1 of the case C and a fixing bolt V1 is inserted into the collar 59A from the front. The fixing bolt V1 then is tightened into a bolt-fixing hole C3 in the case C of the equipment, as shown in FIG. 6, to fix the equipment-side housing 52 to the case C.

Two male terminal fittings 51 are accommodated side by side in the terminal fitting holding part 56. As shown in FIG. 6, each male terminal fitting 51 has an approximately conic body 61, a pin-shaped connection part 62 extended forward from the body 61, and an insulation head 62A formed by molding a synthetic resin at the front end of the pin-shaped connection part 62. The pin-shaped connection part 62 projects forward from a rear wall of the hood 55 and extends to approximately the center of the hood 55 in the forward and backward direction. The insulation head 62A prevents operator's fingers inserted into the hood 55 from directly touching the pin-shaped connection part 62 when the wire-side connector 20 is separated from the equipment-side connector 50. The insulation head 62A and the pin-shaped connection part 62 can be inserted into the cylindrical connection part 21A of the female terminal fitting 21. The pin-shaped connection part 62 is in the cylindrical connection part 21A, as shown in FIG. 8, when the wire-side connector 20 and the equipment-side connector 50 are fit together normally so that the male and female terminal fittings 51 and 21 are connected electrically to each other.

An interlocking connector 63 is mounted into the terminal fitting holding part 56 from the rear and between the male terminal fittings 51, as shown in FIG. 6, and a back retainer 68 prevents the interlocking connector 63 from being removed from the terminal fitting holding part 56. A fit-on detection terminal 63A is mounted in the interlocking connector 63 and connects to the short-circuit terminal 25A of the interlocking fit-on part 25, as shown in FIG. 8, when the wire-side connector 20 and the equipment-side connector 50 are fit normally together. Thus, it is possible to detect a properly connected state of the wire-side connector 20 and the equipment-side connector 50.

As shown in FIGS. 6 and 8, two guide plates 64 extend forward from a rear wall of hood 55 and project into the inner space of the hood 55. The guide plates 64 are disposed between the male terminal fittings 51 and the interlocking connector 63 with the front ends of the guide plates 64 disposed slightly forward from the front end of the male terminal fittings 51. The guide plates 64 are accommodated respectively in the slits 22A of the wire-side housing 22 to guide the wire-side connector 20 and the equipment-side connector 50 to a predetermined position.

Figure 12:
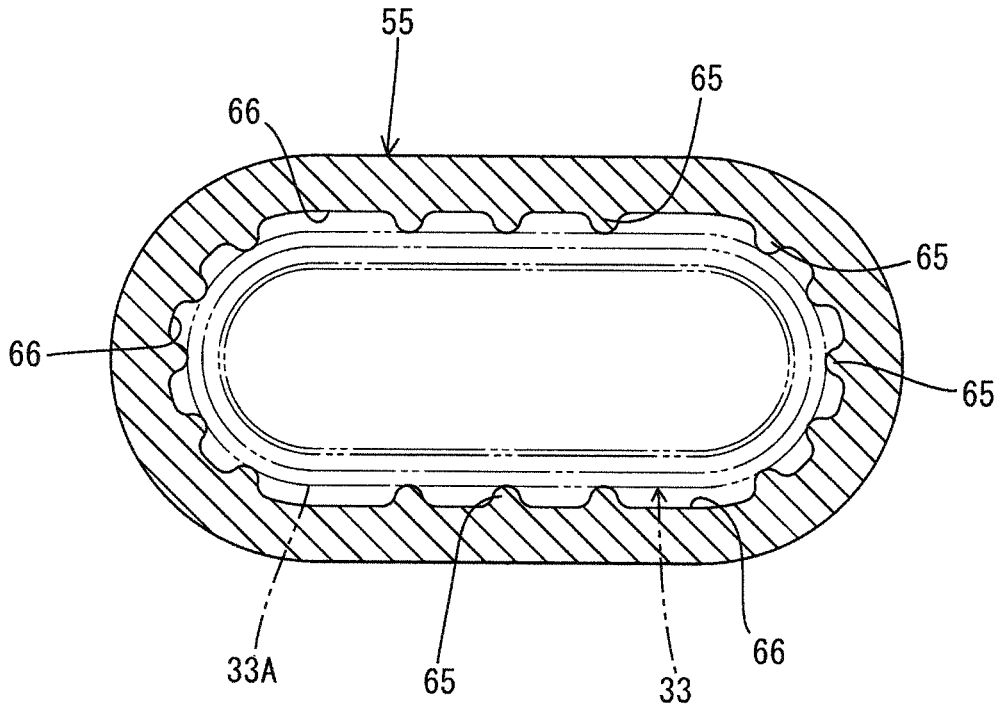
FIG. 12 is a sectional view of the equipment-side connector housing.

Rubber ring interference ribs 65 project in from the inner peripheral surface of the hood 55, as shown in FIG. 12, and extend linearly in the forward and backward direction at positions on the inner peripheral surface of the hood 55 forward of the sealing surface 55A, as shown in FIG. 6. A projected end of each rubber ring interference rib 65 is rounded, as shown in FIG. 12, and the height of each rubber ring interference rib 65 equals the height of the sealing surface 55A of the hood 55.

Three rubber ring interference ribs 65 are formed at equal intervals on each wide surface in the hood 55. Five rubber ring interference ribs 65 are formed at equal intervals on each curved surface in the hood 55. As shown in FIG. 12, an oblong formed by circumferentially connecting surfaces between the adjacent rubber ring interference ribs 65 is slightly larger than an oblong formed by circumferentially connecting the projected ends of the rubber ring interference ribs 65. As shown in FIG. 5, air release grooves 66 are defined on the inner peripheral surface of the hood 55 forward of the sealing surface 55A and between the rubber ring interference ribs 65. Therefore the rubber ring 33 of the wire-side connector 20 contacts only the rubber ring interference ribs 65 from the time when the cylindrical fit-on parts 24 and the interlocking fit-on part 25 of the wire-side connector 20 are fit shallowly in the hood 55 of the equipment-side connector 50 until the time when the entire outer periphery of the rubber ring 33 closely contacts the sealing surface 55A of the hood 55. The partly fit state of the wire-side connector 20 and the equipment-side connector 50 shown in FIGS. 7 and 10 is immediately before the entire outer periphery of the rubber ring 33 closely contacts the sealing surface 55A. Thus, air inside the hood 55 is discharged through the air release grooves 66 and to the outside of the hood 55 to reduce the internal pressure of the hood 55 while fitting the cylindrical fit-on parts 24 and the interlocking fit-on part 25 of the wire-side connector 20 in the hood 55.

Two loosening prevention ribs 67 are formed on the outer peripheral surfaces of the cylindrical fit-on parts 24 of the wire-side housing 22 and can be accommodated in the air release grooves 66 on the long sides of the hood 55. The loosening prevention ribs 67 are formed rearward from the rubber ring 33 fit on the cylindrical fit-on parts 24 and hold the wire-side housing 22 in the normal posture when the wire-side connector 20 and the equipment-side connector 50 are fit normally together.

The equipment-side connector 50 initially is fit shallowly on the wire-side connector 20 under the guide of the slit 22A of the wire-side connector 22 and the guide plate 64 of the equipment-side housing 52. At this time, the rubber ring 33 of the wire-side housing 22 closely contacts the rubber ring interference ribs 65 of the hood 55 of the equipment-side housing 52.

The operation of fitting the equipment-side connector 50 and the wire-side connector 20 together proceeds to the semi-fit-on state, shown in FIGS. 7 and 10, so that the cylindrical fit-on parts 24 and the interlocking fit-on part 25 are fit in the hood 55, and the hood 55 is fit in the shielding shell 23. The tightening bolt V then enters the bolt-tightening hole C2 of the case C and can be screwed into the bolt-tightening hole C2 to pull the equipment-side connector 50 and the wire-side connector 20 into the properly connected state shown in FIGS. 8 and 11. During this fit-on process, the rubber ring 33 of the wire-side connector 20 slides along only the rubber ring interference ribs 65 until the rubber ring 33 closely contacts the sealing surface 55A of the hood 55. Thus, air inside the hood 55 is discharged through the air release grooves 66 and outside from the open portion of the hood 55. The entire outer periphery of the rubber ring 33 of the wire-side housing 22 closely contacts the sealing surface 55A of the hood 55 when the equipment-side connector 50 and the wire-side connector

20 are fit normally together, thus sealing the gap between the hood 55 and the wire-side housing 22. Therefore, internal pressure of the waterproof connector does not rise significantly during the connection process and the operational force required to fit the wire-side connector 20 and the equipment-side connector 50 together is low.

The rubber ring interference ribs 65 are disposed intermittently at almost equal intervals on the inner peripheral surface of the hood 55. Thus, the wire-side housing 22 and the equipment-side housing 52 are held in the normal fit-on posture. Further, the rubber ring 33 of the wire-side housing 22 initially contacts only the rubber ring interference ribs 65 to decrease a contact resistance between the rubber ring 33 and the hood 55. Hence, a low operational force is required to fit the wire-side connector 20 and the equipment-side connector 50 together.

The invention is not limited to the embodiments described above with reference to the drawings. For example, the following embodiments also are included in the scope of the invention.

In the above-described embodiment, the wire-side connector 20 and the equipment-side connector 50 are fit normally together by tightening the tightening bolt into the case C. However, the invention also is applicable to a waterproof connector that fits the wire-side connector 20 and the equipment-side connector 50 together without using the tightening bolt V.

The above-described embodiment has the shielding shell 23 conductively connectable to the case C of the equipment. However, the invention is widely applicable to a waterproof connector with shielding shell.

The above-described embodiment has a plurality of the air release grooves 66. However, only one air release groove 66 may be formed.

The above-described embodiment has the air release grooves 66 extending from the open portion of the hood 55 to the sealing surface 55A. However, an air release hole may penetrate through the hood 55 at a position forward from the sealing surface 55A of the hood 55.

The rubber ring interference ribs 65 need not be linear ribs extending in the forward and backward direction, and can extend in other directions (e.g. obliquely) or can take other forms (e.g. discontinuous bumps).

What is claimed is:

1. A waterproof connector comprising:

a first housing having a fit-on part with an outer periphery;

a rubber ring fit on the outer periphery of the fit-on part; and a second housing with a hood having an inner space with an open front end that can receive the fit-on part, an inner sealing surface spaced rearward from the open front end, the inner sealing surface being configured for sealing engagement with the rubber ring when the fit-on part of the first housing is fit completely into the hood, a plurality of ribs spaced circumferentially from one another and extending from the inner sealing surface of the hood to the open front end, inner ends of the ribs being substantially flush with the inner sealing surface and air release parts defined between the ribs and extending from the inner sealing surface to the open front end of the hood, the air release parts occupying a larger surface area in the hood than the ribs for accommodating a release of air from the hood as the fit-on part of the first housing approaches a position in the hood where the rubber ring engages the inner sealing surface.

2. The waterproof connector of claim 1, wherein the at least one air release part is at least one air release groove that extends from the inner sealing surface of the hood to the open front end thereof, the air release groove being open toward the inner space of the hood.

3. The waterproof connector of claim 2, wherein the at least one air release groove comprises a plurality of air release grooves formed on said inner peripheral surface of said hood.

4. The waterproof connector of claim 1, wherein each of the ribs has an inwardly directed peak substantially aligned with the inner sealing surface of the hood.

5. The waterproof connector of claim 1, wherein the ribs and the air release grooves are substantially parallel.

6. The waterproof connector of claim 1, wherein the ribs and the air release grooves are substantially linear.

7. The waterproof connector of claim 1, wherein the ribs and the air release grooves extend substantially parallel to an insertion direction of the first housing into the hood.

8. The waterproof connector of claim 1, wherein the hood comprises first and second substantially parallel wide surfaces and first and second opposite curved surfaces formed between the wide surfaces, the ribs comprising a plurality of the ribs on each of the wide surfaces and on each of the curved surfaces.

9. The waterproof connector of claim 8, wherein the plurality of ribs comprise three of the ribs at substantially equal intervals on each of the wide surfaces of the hood and five of the ribs at substantially equal intervals on each of the curved surfaces of the hood.

* * * * *